US008104864B2

(12) United States Patent
Terada

(10) Patent No.: US 8,104,864 B2
(45) Date of Patent: Jan. 31, 2012

(54) IMAGE RECORDING DEVICE

(75) Inventor: Kohei Terada, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 29 days.

(21) Appl. No.: 12/475,109

(22) Filed: May 29, 2009

(65) Prior Publication Data

US 2009/0295862 A1 Dec. 3, 2009

(30) Foreign Application Priority Data

May 30, 2008 (JP) ..... 2008-143827
Feb. 27, 2009 (JP) ..... 2009-045835

(51) Int. Cl.
*B41J 2/165* (2006.01)

(52) U.S. Cl. ..... 347/20

(58) Field of Classification Search ..... None
See application file for complete search history.

(56) References Cited

U.S. PATENT DOCUMENTS 7,056,559 B2 * 6/2006 Nakajima et al. ..... 427/466

FOREIGN PATENT DOCUMENTS

| | | | |
|---|---|---|---|
| JP | S63-41560 | U | 3/1988 |
| JP | H05-41816 | U | 6/1993 |
| JP | 2002-234152 | A | 8/2002 |
| JP | 2002-240380 | A | 8/2002 |

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

There is provided an image recording device, comprising: a platen that supports a recording medium; a carriage that is located to face the platen and is configured to move in a first direction along the recoding medium; a recordation head that is mounted on the carriage and performs image recordation on the recording medium; a long member elongated, to face the platen, in the first direction within a region in which the carriage moves; a support member that fixes the long member such that the long member does not move in the first direction relative to the platen; and a guide member that is located on the carriage to deform the long member such that the carriage and the platen face directly with respect to each other.

19 Claims, 13 Drawing Sheets

IMAGE RECORDING DEVICE

CROSS-REFERENCE TO RELATED APPLICATION

This application claims priority under 35 U.S.C. §119 from Japanese Patent Applications No. 2008-143827, filed on May 30, 2008, and No. 2009-045835, filed on Feb. 27, 2009. The entire subject matter of the applications is incorporated herein by reference.

BACKGROUND

1. Technical Field

Aspects of the present invention relate to an image recording device having a recordation head mounted on a carriage moving in a predetermined direction to perform image recordation on a sheet of paper placed on a platen.

2. Related Art

Ink jet type printers which perform image recordation on a sheet of recording medium such as a sheet of paper have been widely used. In the printer of this type, the sheet of paper is carried to a platen while being sandwiched by a pair of rollers located to face with each other. When the sheet of paper reaches the platen, the pair of rollers are driven intermittently so that, while the rollers are stopped intermittently, ink drops are ejected from a recordation head during a reciprocating motion of the recordation head. By thus ejecting ink drops from the recordation head to the sheet of paper, a required image can be formed on the sheet of paper. That is, by repeating such motion, the image recordation is performed successively from the leading edge to the trailing edge of the sheet of paper.

In general, the printer is capable of performing the image recordation on various types of recording medium including an envelope. Furthermore, there is a case where, after image recordation is performed on one side of a sheet of paper, image recordation is further performed on the other side of the sheet of paper in the image recording device, for the purpose of double-side printing or reuse of sheets of paper. In this regard, it should be noted that if the recording medium such as an envelope having a folded part is used, a possibility that a part of the envelope protruding toward the recordation head contacts a carriage or the recordation head arises.

Regarding the double-side printing, there is a case where warpage is caused on a sheet of paper when the image recordation is performed on one side of the sheet of paper. In this case, the warped part of the sheet of paper might contact the carriage or the recordation head when the image recordation is performed for the other side of the sheet of paper. Regarding reuse of sheets of paper, there is a possibility that warpage is produced on a sheet of paper when the image recordation is performed, and the warped part of the sheet of paper contacts the carriage or the recordation head.

If the sheet of paper contacts the carriage or the recordation head, the sheet of paper might be damaged. Recently, the interval between the sheet of paper and the recordation head is becoming shorter for the purpose of achieving high-precision image recordation, and therefore the possibility of paper jamming due to the above described reasons is increasing.

Sheets of paper includes vertical paper grain type paper of which direction of fibers is oriented in the vertical direction and lateral paper grain type paper of which direction of fibers is oriented in the lateral direction. If the sheet of paper of the lateral paper grain type is used while being carried in the direction of the longer side of the paper, relatively larger warpage is produced on the sheet of paper in comparison with the vertical paper grain type paper. Therefore, in addition to the case of the double-side printing, the paper jamming may be caused in the single-side printing. Such a problem of paper jamming is caused not only in the inkjet printers but also in dot-impact printers.

Japanese Patent Provisional Publication No. 2002-240380A (hereafter, referred to as JP 2002-240380A) discloses a dot impact printer having a carriage on which a recordation head is mounted. More specifically, in this printer, a strip-shaped film is connected to the carriage, and the film is wound by winding rollers provided at both end portions defined in an opening in which the carriage moves. The film contributes to preventing occurrence of paper jamming by moving together with the carriage.

Japanese Utility Model Provisional Publication No. HEI 5-41816U (hereafter, referred to as JP HEI 5-41816U) also discloses a printer having a belt connected to a carriage for preventing occurrence of paper jamming.

SUMMARY

However, in the printers disclosed in JP 2002-240380A and JP HEI 5-41816U, the film or the belt moves together with the carriage. Therefore, when the film or the belt contacts the sheet of paper, the sheet of paper might be moved in the moving direction of the carriage by friction between the carriage and the sheet of paper, and thereby an image formed on the sheet of paper might be damaged. Such a problem becomes more pronounced as the interval between the recordation head and the sheet of paper decreases.

There is a possibility that, if the film or the belt moves relative to the sheet of paper before ink drops fallen on the sheet of paper dries, the film or belt may contacts the not-dried ink on the sheet of paper and thereby the image on the sheet of paper may be damaged. Furthermore, ink adhered to the film or the belt may soil the sheet of paper which will subsequently be subjected to the image recordation. Such a problem may also occur when ink mist adheres to the film or the belt.

In the inkjet type image recording device, a maintenance unit for maintenance operation, such as a purging operation in which ink is sucked fro nozzles of the recordation head and flushing operation in which ink drops are ejected from the recordation head, is provided for the purpose of preventing drying or clogging of nozzles or removing air bubbles from the nozzles. It is also desirable that the image recording device having such a maintenance unit is provided with the above described film or belt.

Aspects of the present invention are advantageous in that an image recording device configured to prevent occurrence of paper jamming on a platen and to prevent sheets of paper from being damaged is provided.

According to an aspect of the invention, there is provided an image recording device, comprising: a platen that supports a recording medium; a carriage that is located to face the platen and is configured to move in a first direction along the recoding medium; a recordation head that is mounted on the carriage and performs image recordation on the recording medium; a long member elongated, to face the platen, in the first direction within a region in which the carriage moves; a support member that fixes the long member such that the long member does not move in the first direction relative to the platen; and a guide member that is located on the carriage to deform the long member such that the carriage and the platen face directly with respect to each other.

According to the above describe configuration, the long member does not move in the first direction relative to the platen even if the carriage moves in the first direction. Therefore, it is possible to perform image recordation while moving the carriage in the first direction in a state where the recording medium is kept at a certain distance from the recordation head. Consequently, it becomes possible to prevent occurrence of paper jamming on the platen and to prevent an image form on the recording medium from being damaged because the recording medium is not moved on the platen.

In at least one aspect, the guide member deforms the long member in accordance with movement of the carriage in such a manner that the long member deforms in a second direction to move away from or approach the platen.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
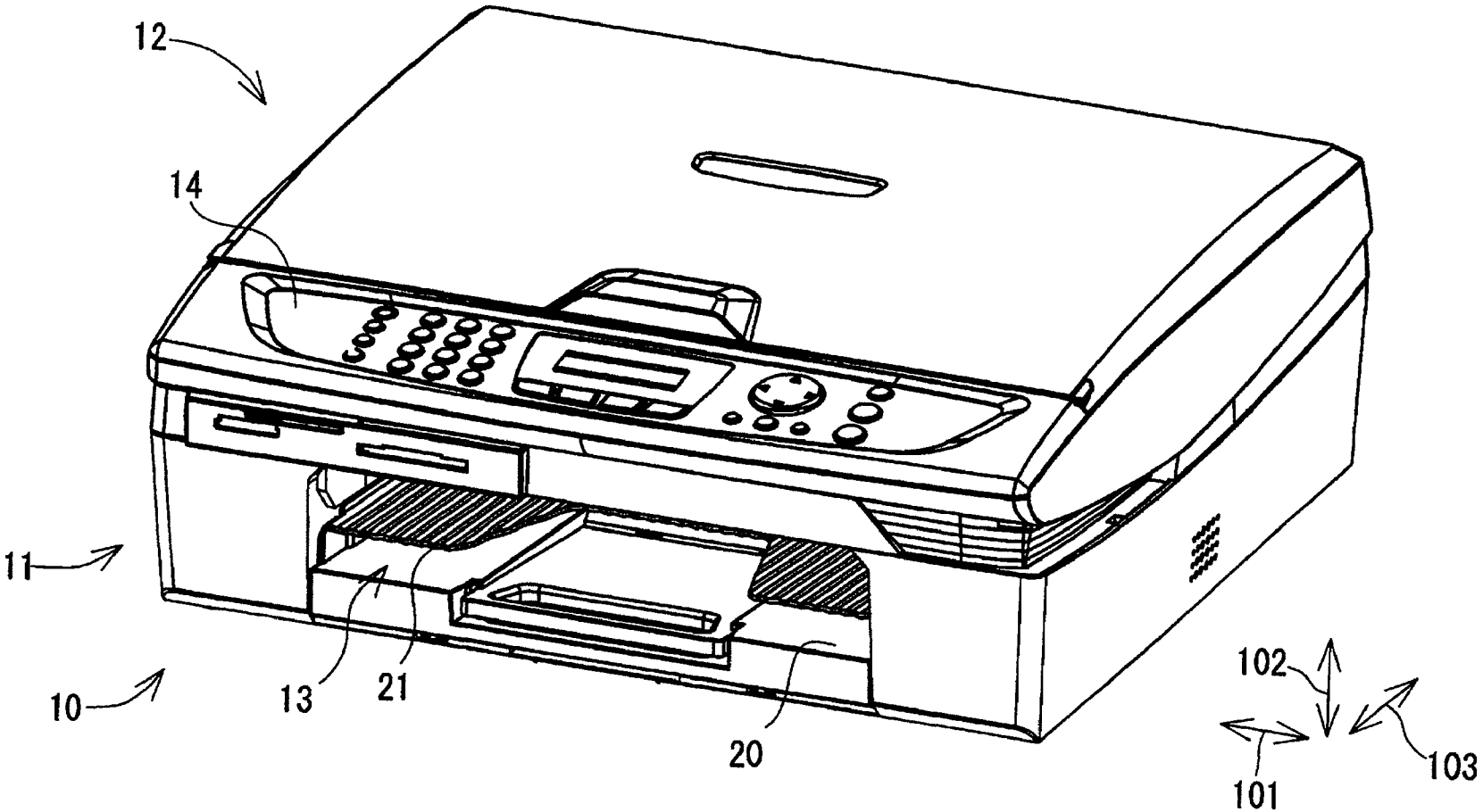
FIG. 1 is a perspective view illustrating an outer appearance of a MFP (Multifunction Peripheral) 10 according to a first embodiment.
Figure 2:
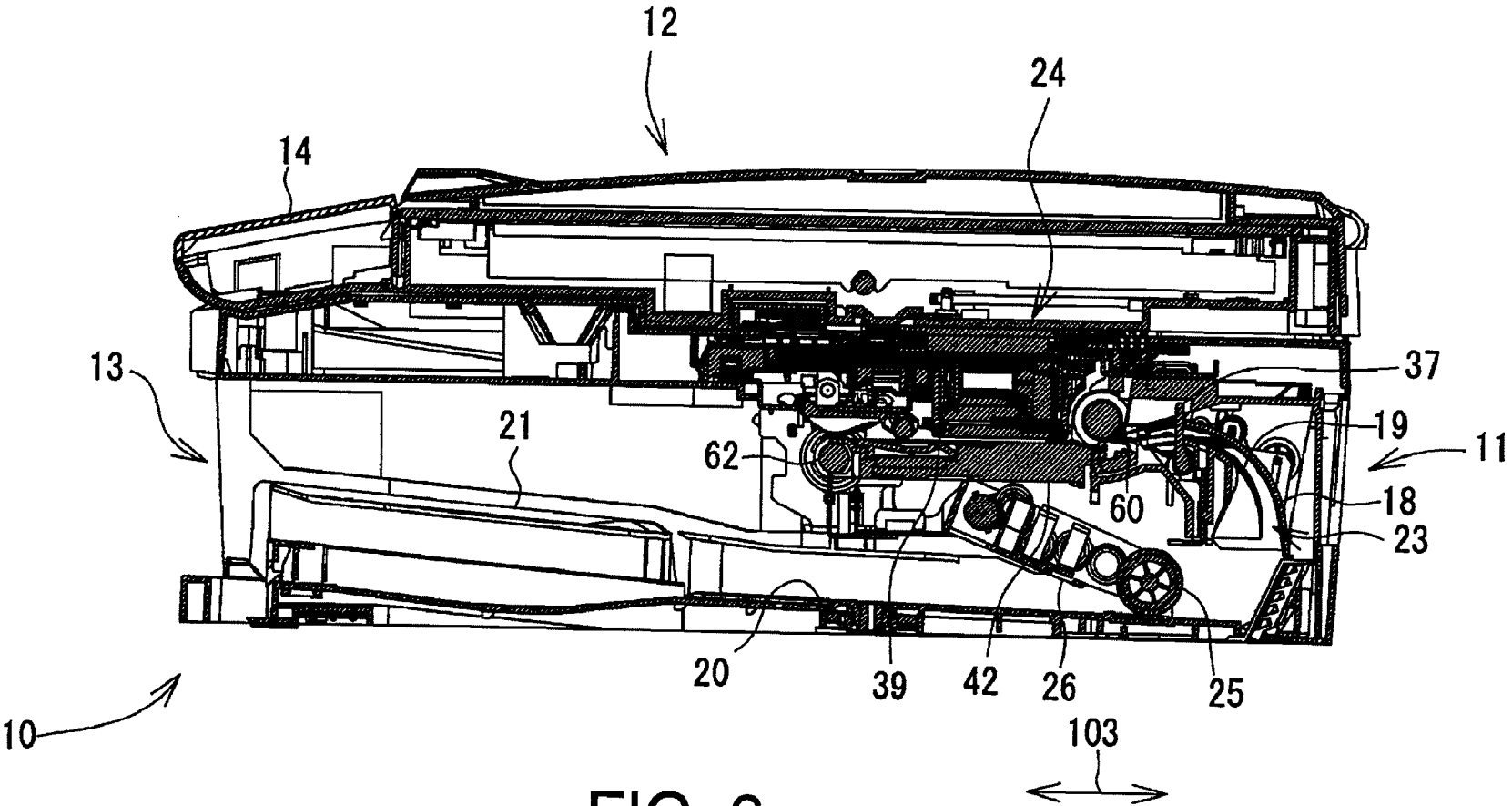
FIG. 2 is a cross sectional view illustrating an internal configuration of the MFP.

FIG. 1 is a perspective view illustrating an outer appearance of an MFP (Multifunction Peripheral) 10 according to a first embodiment. FIG. 2 is a cross sectional view illustrating an internal configuration of the MFP 10. As shown in FIGS. 1 and 2, the MFP 10 includes a print unit 11 and a scanner unit 12 which are integrally provided. The MFP 10 has a print function, a scanner function, a copy function and a facsimile function. The print unit 11 serves as an image recoding device. It should be noted one or more of the functions other than the print function may be omitted. For example, the present invention may be applied to a device having only the print function and not having the scanner unit 12 (i.e., not having the scanner and copy functions).

In the MFP 10, the print unit 11 is located on the lower side, and the scanner unit 12 is located on the upper side. The print unit 11 is connected to an external device such as a computer, and is able to record an image and text on a recording medium based on print data (e.g., image data or document data) transmitted from the external device. The scanner 12 is formed as a so-called flat-bed scanner.

The MFP 10 has a wide and thin outer shape formed in a rectangular parallelepiped shape. That is, the MFP 10 has a width (in a direction indicated by an arrow 101) and a depth (in a direction indicated by an arrow 103) larger than a height (in a direction indicated by an arrow 102). On the front of the print unit 11, an opening 13 is formed. In the inside of the opening 13, a paper supply tray 20 and an output tray 21 are provided. The sheets of paper accommodated in the paper supply tray 20 are supplied to the inside of the print unit 11 one by one to form an required image on the sheet of paper, and the sheet of paper after image recordation is ejected to the output tray 21.

On the upper front portion of the MFP 10, an operation panel 14 is provided. A user is able to input commands to control the print unit 11 and the scanner unit 20 to perform a required operation through the operation panel 14. The operation panel 14 includes a plurality of buttons for input, and a display on which various types of information, such as a status of the MFP 10 or error information, is displayed. The MFP 10 is also able to operate in accordance with commands transmitted from the external device connected to the MFP 10 through a printer driver or a scanner driver.

As shown in FIG. 2, the paper supply tray 20 is located on the bottom of the MFP 10. The output tray 21 is located on the upper side of the paper supply tray 20. That is, the output tray 21 and the paper supply tray 20 form a two-layer structure. The paper supply tray 20 and the output tray 21 are connected through a paper carrying path 23 through which the sheet of paper is carried. The sheet of paper placed in the paper supply tray 20 is guided from the lower side to the upper side while turning in a form of a letter U, and is carried to an image recordation unit 24. In the image recordation unit 24, image recordation is performed, and the sheet of paper after image recordation is ejected to the output tray 21.

The paper supply tray 20 is formed to be a casing having an opening on the top side thereof. In the inner space of the paper supply tray 20, a stack of image recording media (e.g., sheets of paper) can be accommodated. For example, in the paper supply tray 20, various types of sheets of paper having a size smaller than or equal to A3 size (e.g., A4 size, B5 size, post card size) can be accommodated.

The paper output tray 21 has a form of a tray, and is formed such that the sheet of paper can be ejected on the upper surface thereof. The output tray 21 is located on the front side of the MFP 10 with respect to the paper supply tray 20 in the depth direction (in the direction indicated by the arrow 103).

In the deepest portion of the MFP 10, a feed roller 25 is provided. The feed roller 25 serves to supply the sheet of paper stacked on the paper supply tray 20 to the paper carrying path 23. The feed roller 25 rotates by receiving a driving force from a motor (not shown). The feed roller 25 is rotatably supported at a tip of a supply arm 26. The supply arm 26 is provided to be rotatable. That is, the supply arm 26 is provided such that the tip at which the feed roller 25 is attached is able to swing with respect to a proximal end portion thereof.

By the rotational motion of the supply arm 26, the supply roller 25 moves up and down to approach or move away from the sheet of paper. The supply arm 26 is pressed downward by a pressing member (e.g., a spring) or the supply roller 25's weight to be rotated downward, and moves upward in accordance with the amount of the sheets of paper accommodated in the paper supply tray 20. Therefore, the supply roller 25 contacts the top of the stacked sheets of paper in the paper supply tray 20. When the supply roller 25 is rotated in this state, the sheet of paper at the top of the stacked sheets of paper is sent out by friction between the surface of the supply roller 25 and the sheet of paper and is supplied to the paper carrying path 23.

The paper carrying path 23 is formed to extend upward from the back side of the paper supply tray 20, to bend toward the front side, extend to from the back side to the front side of the MFP 10, and then connect to the output tray 21 through the image recordation unit 24. The paper carrying path 23 is formed by an outer guide face and an inner guide face facing with each other at a certain interval, excepting a portion around which the image recordation unit 24 is located. For example, in a portion where the paper carrying path 23 bends on the back side of the MFP 10, the paper carrying path 23 is formed by an outer guide member 18 and an inner guide member 19.

Figure 3:
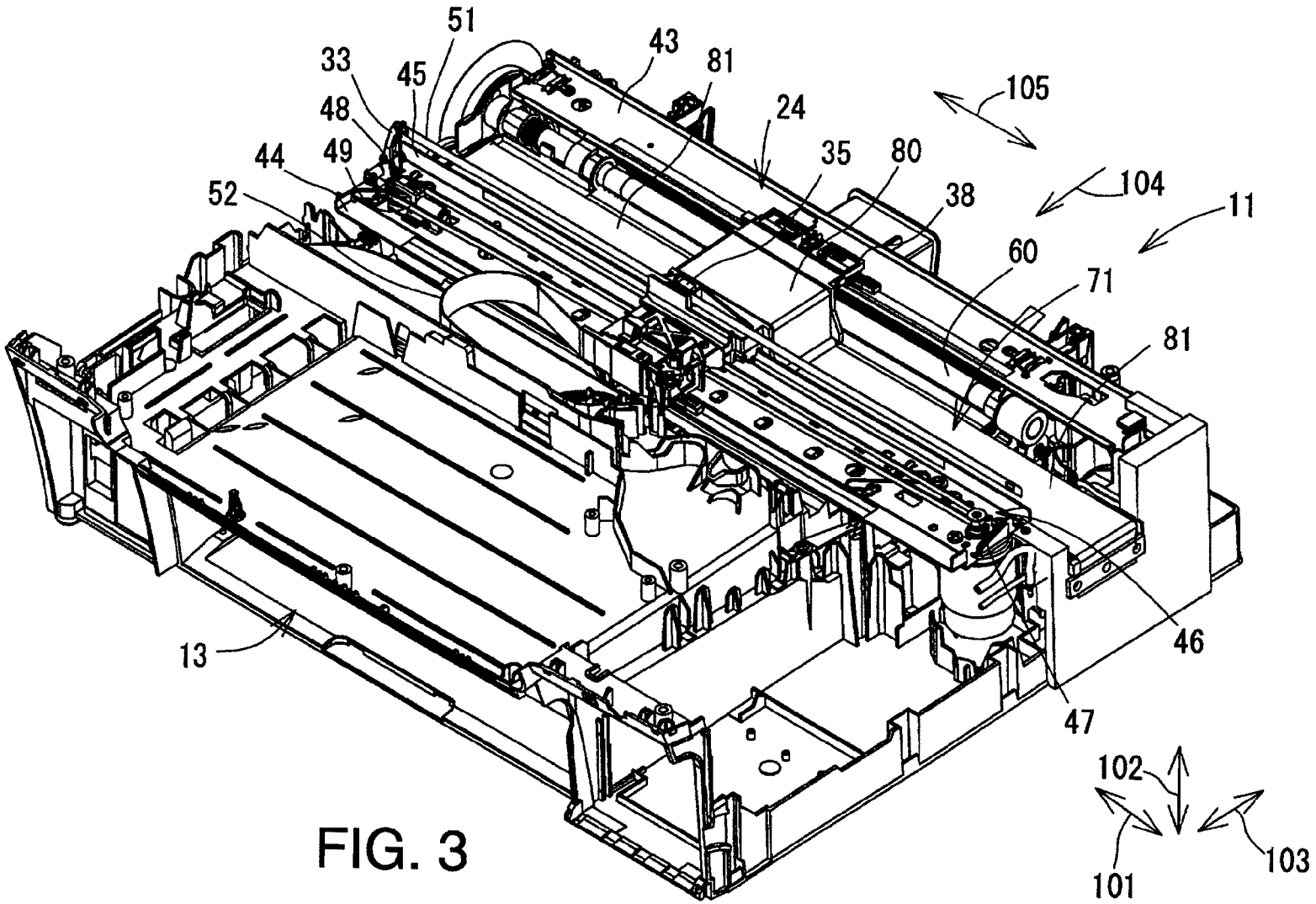
FIG. 3 is a perspective view illustrating the inner configuration around an image recordation unit of the MFP.

FIG. 3 is a perspective view illustrating the inner configuration around the image recordation unit 24 of the MFP 10. As shown in FIGS. 2 and 3, the image recordation unit 24 includes, as main parts, a recordation head 39 and a platen 42. The recordation head 39 and the platen 42 are provided to face with each other at a predetermined interval. The image recordation unit 24 is explained in detail later.

Figure 9:
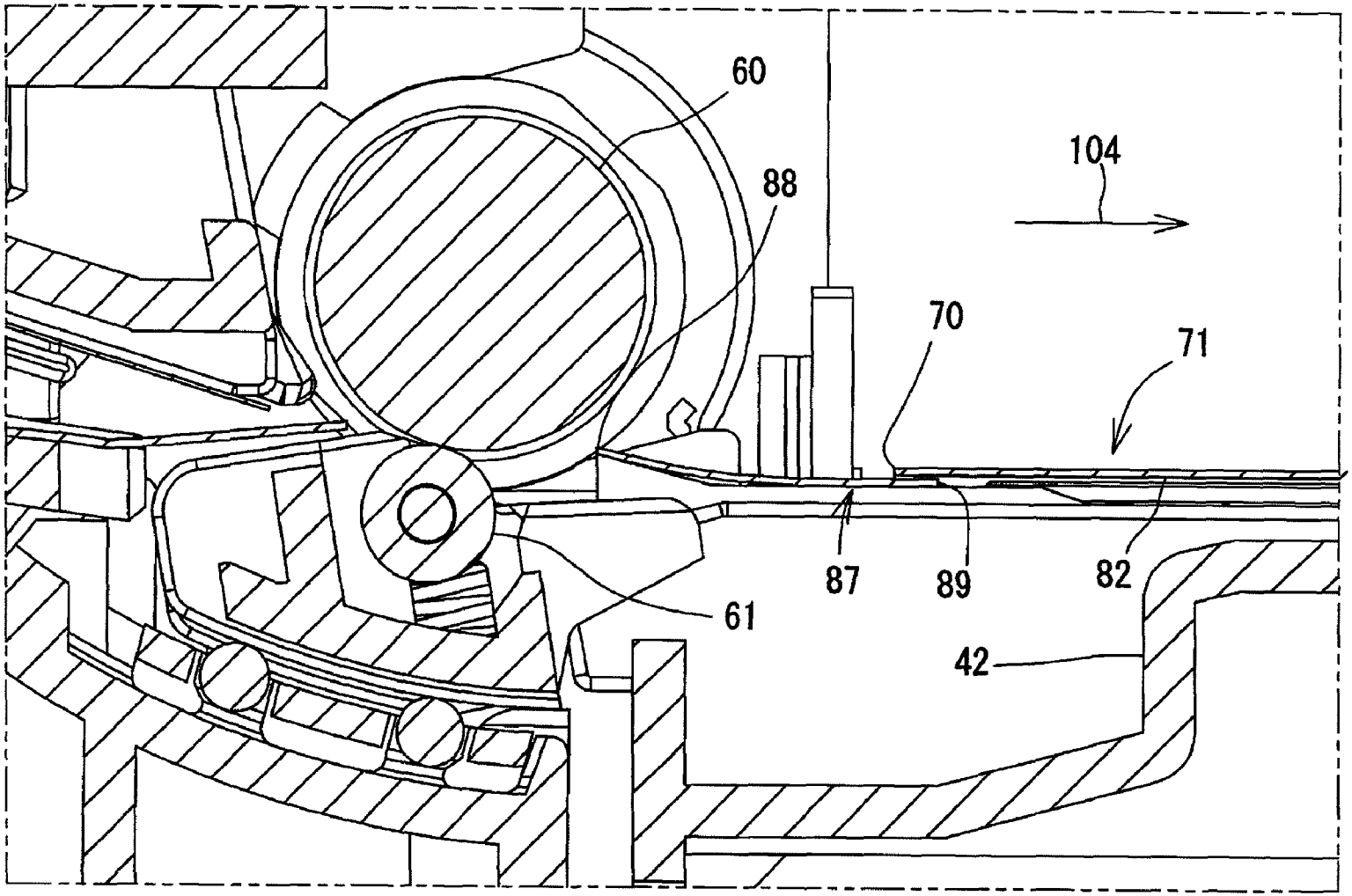
FIG. 9 is an enlarged cross section viewed along a cut line IX-IX in FIG. 4.

On the upstream side in a normal carrying direction 104 with respect to the image recordation unit 24, a pair of a carrying roller 60 and a pinch roller 61 are provided. Although in FIGS. 2 and 3 the pinch roller 61 is hidden, the pinch roller 61 is provided under the carrying roller 60 such that the pinch roller 60 is able to approach or move away from the carrying roller 60 and is closely contact the carrying roller while being pressed against the carrying roller 60 by an elastic member such as a spring as shown in FIG. 9. The carrying roller 60 rotates while receiving a driving force from a motor (not shown). In this embodiment, although explanations are made for the case where the sheet of paper is carried in the normal carrying direction 104, it should be understood that the present invention is not limited to such a case where the sheer of paper is carried in one of the normal carrying direction 104 and the inversed carrying direction.

The sheet of paper is carried in the normal carrying direction 104 by rotation of the carrying roller 60 while being sandwiched between the carrying roller 60 and the pinch roller 61. In this case, the pinch roller 61 rotates in response to carrying of the sheet of paper.

On the downstream side in the normal carrying direction 104 with respect to the image recordation unit 24, a pair of an ejection roller 62 and a gearwheel are provided. Although in FIGS. 2 and 3 the gearwheel is hidden by another member, the gearwheel is provided on the upper side of the ejection roller 62 such that the gearwheel is able to approach or move away from the ejection roller 62, and closely contacts the ejection roller 62 while being pressed against the ejection roller 62 by an elastic member such as a spring.

When viewed in an axis direction of the gearwheel, the gearwheel is formed such that a plurality of projections each projecting in a radial direction in a chevron shape are arranged along the circumferential direction of the gearwheel. A tip of each projection of the gearwheel contacts a recordation surface of the sheet of paper. The ejection roller 62 rotates while receiving a driving force from a motor (not shown). Rotations of the ejection roller 62 are controlled to be in synchronization with rotation of the carrying roller 60. The ejection roller 62 and the gearwheel carry the sheet of paper after image recordation to the output tray 21 while sandwiching the sheet of paper therebetween.

The carrying roller 60, the pinch roller 61, the ejection roller 62 and the gearwheel serve as a carrying unit.

For image recordation, the carrying roller 60 and the ejection roller 62 are driven intermittently. In the intermittent driving of the rollers, each of the carrying roller 60 and the ejection roller 62 is continuously driven by a predetermined target carrying amount, and is stopped for a predetermined time period after the predetermined target carrying amount is reached. The predetermined target carrying amount is changed depending on the resolution of an image to be recorded. For example, when the image recordation is performed in an interlace scheme, the predetermined target carrying amount for a fine mode where image recordation is performed in a high resolution mode is set to a smaller amount than the predetermined target carrying amount for a normal mode where image recordation is performed in an intermediate resolution mode.

It should be noted that while the image recordation is not executed, the carrying roller 60 and the ejection roller 62 need not be driven intermittently. Therefore, the carrying roller 60 and the ejection roller 62 may be rotated continuously for the supplying of the sheet of paper before the image recordation or for ejection of the sheet of paper after image recordation.

As shown in FIG. 2, on the upstream side in the normal carrying direction 104 along the paper carrying path 23 with respect to the carrying roller 60, a registration sensor 37 is provided. The registration sensor 37 detects presence or absence of the sheet of paper passing through the paper carrying path 23. By checking an ON/OFF state of an output signal from the registration sensor 37, it is possible to judge whether the leading edge or the trailing edge of the sheet of paper reaches the position of the registration sensor 37.

Figure 4:
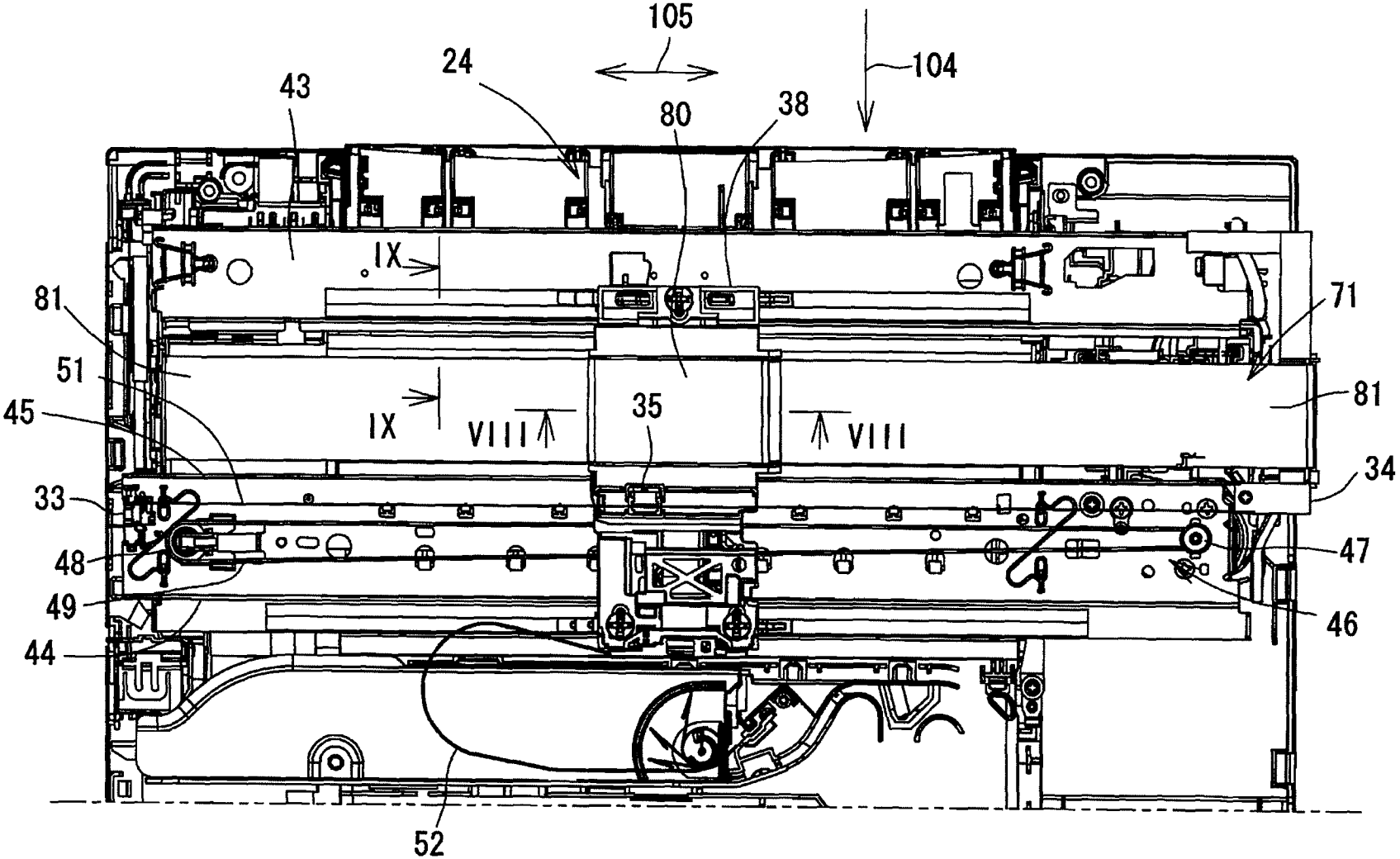
FIG. 4 is a top view illustrating the inner configuration around the image recordation unit.

As shown in FIGS. 3 and 4, the image recordation unit 24 includes, as main parts, a carriage 38, the recordation head 39 and the platen 42.

As shown in FIGS. 2 to 4, the carriage 38 and the platen 42 are located on the downstream side of the carrying roller 60 and the pinch roller and on the upstream side of the ejection roller 62 and the gearwheel, along the paper carrying path 23 in the normal carrying direction. The carriage 38 and the platen 42 are provided on the upper side and the lower side, respectively, with respect to the paper carrying path 23, and face with each other with respect to the paper carrying path 23.

The carriage 38 has a rectangular parallelepiped shape (i.e., a hexahedron). On the carriage 38, the recordation head 39 is mounted. The carriage 38 makes a reciprocating motion in a horizontal direction (i.e., a reciprocating direction 105) which is perpendicular to the normal carrying direction 104.

Although not shown in each figure, an ink cartridge is separately provided with respect to the recordation head 39. From the ink cartridge, each of cyan (C), magenta (M), yellow (Y) and black (Bk) ink is supplied to the recordation head 39 via an ink tube (not shown).

Figure 6:
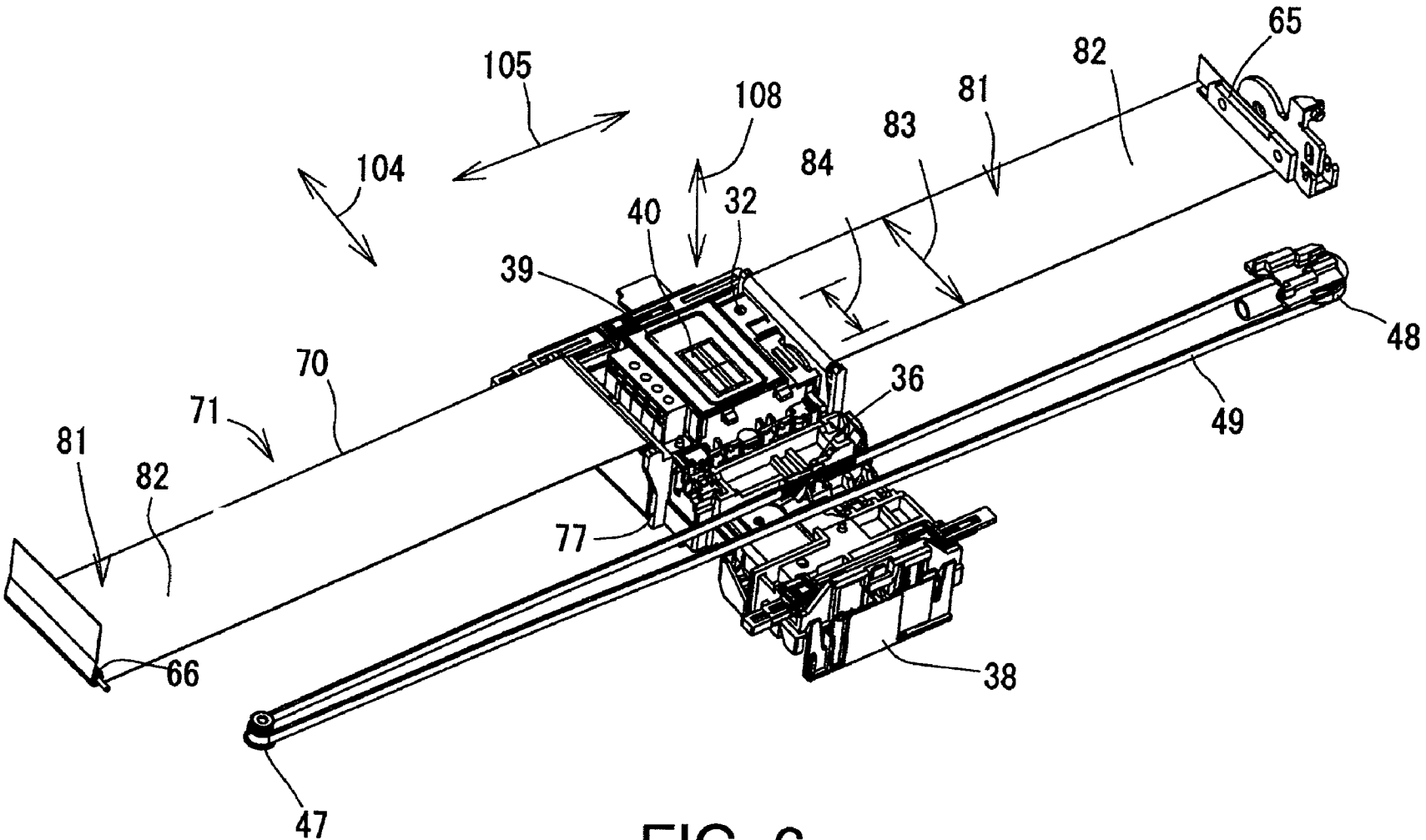
FIG. 6 is a perspective view illustrating the carriage and the guide film viewed from a lower side.

FIG. 6 is a perspective view illustrating the carriage 38 and a guide film 71 viewed from a lower side. As shown in FIG. 6, a part of the recordation head 39 is exposed on a surface where the carriage 38 faces the platen 42. Hereafter, the exposed surface is referred to as a nozzle surface 40. Although not shown in FIG. 6 in detail, a plurality of nozzle orifices are formed on the nozzle surface 40. The nozzles are arranged in a line along the normal carrying direction for each color of C, M, Y and Bk. Ink drops of respective colors are ejected from the nozzles through vibration of a piezoelectric element provided in the recordation head 39.

While the carriage 38 is reciprocated, a minute ink drop of each color is selectively ejected from each nozzle. Consequently, an image is recorded on the sheet of paper being carried on the platen 42. It should be noted that the number of nozzles and the pitch of nozzles along the normal carrying direction can be adjusted depending on various factors such as resolution of an image to be recorded. Furthermore, the number of lines of nozzles can be increased or decreased depending on the number of ink colors.

As shown in FIG. 6, a paper sensor 32 is provided on the carriage 38. The paper sensor 32 is a reflective photosensor. Although not shown in figures in detail, the paper sensor 32 includes a light-emitting device and a photoreceptor. The light-emitting device emits light toward the platen 42, and the photosensor receives light reflected from the platen 42. The paper sensor 32 outputs an electric signal corresponding to the received level of light on the photoreceptor.

The top surface of the platen 42 has a reflection coefficient different from a reflection coefficient of the sheet of paper. In general, since the sheet of paper is white, the top surface of the platen 42 is colored in black. Since the reflection coefficients of the platen 42 and the sheet of paper are different from each other, it is possible to detect presence or absence of the sheet of paper on the platen 42 in accordance with change of the signal level from the paper sensor 32.

As shown in FIGS. 3 and 4, a pair of guide rails 43 and 44 are provide on the upper side of the paper carrying path 23. The guide rails 43 and 44 are located along the normal carrying direction to have a predetermined interval. That is, each of the guide rails 43 and 44 is provided such that the longitudinal direction thereof is along the reciprocating direction 105 of the carriage 38. The guide rails 43 and 44 are provided in the inside of the casing of the print unit 11, and form a part of a frame supporting components of the print unit 11.

The guide rail 43 provided on the upstream side in the normal carrying direction 104 has a form of a flat plate. The length of the guide rail 43 in the longitudinal direction (the reciprocating direction 105) is set to be larger than the reciprocating range of the carriage 38. The guide rail 44 provided on the downstream side in the normal carrying direction 104 has a form of a flat plate, and has the length in the longitudinal direction substantially equal to the length of the guide rail 43 in the longitudinal direction. An edge 45 is formed on the guide rail 43 on the upstream side in the normal carrying direction 104 to be bent upward at substantially the right angle.

The carriage 38 is mounted to bridge the guide rails 43 and 44. That is, an upstream edge of the carriage 38 defined in the normal carrying direction 104 is placed on the guide rail 43, and an downstream edge of the carriage 38 defined in the normal carrying direction 104 is placed on the guide rail 44. Although not illustrated in the figures, the carriage 38 is configured to catch the edge 45 of the guide rail 44 with parts having a high degree of sliding property, such as resin. With this structure, the carriage 38 is properly positioned in the normal carrying direction 104, and is able to slide in the reciprocating direction 105. With sliding motion of the carriage 38, a pair of rollers rotate and slide along the edge 45.

On the guide rail 44, a belt driving mechanism 46 is provided. The belt driving mechanism 46 includes a driving pulley 47, a driven pulley 48 and an endless belt 49. The driving pulley 46 and the driven pulley 48 are located at end portions, respectively, in the longitudinal direction of the guide rail 44. The belt 49 is hooked to the driving pulley 47 and the driven pulley 48. On the inner surface of the belt 49, a plurality of teeth are formed. The teeth form in the inner surface of the belt 49 engage with teeth of the driving pulley 47. The driving pulley 47 is rotated while receiving a driving force from the motor 73 (not shown). With rotation of the driving pulley 47, the belt 49 moves in a rotational motion.

As shown in FIG. 6, a clip 36 is provided on the side of the nozzle surface 40 of the carriage 38. Since the clip 36 catches the belt 49, the carriage 38 is connected to the belt 49. Therefore, in accordance with the rotational motion of the belt 49, the carriage 38 reciprocates along the guide rails 43 and 44. Since the recordation head 39 is mounted on the carriage 38, the recordation head 39 reciprocates in the reciprocating direction 105 with the reciprocating motion of the carriage 38.

As shown in FIGS. 3 and 4, an encoder strip 51 of a linear encoder is located along the guide rail 44. The encoder strip 51 is a strip-shaped member. The encoder strip 51 is formed such that a transmitting part and a light-blocking part are alternately arranged in the longitudinal direction. The encoder strip 51 is supported by supporting parts 33 and 34 respectively provided at end portions in the longitudinal direction, and is formed to extend in the longitudinal direction over the guide rail 44. On the top surface of the carriage 38, an optical sensor 35 which is a transmissive sensor is provided. The optical sensor 35 is located to face the encoder strip 51, and detects a pattern of the encoder strip 51 when the carriage 38 moves on the reciprocating direction. A detection signal of the optical sensor 35 is output as a pulse signal from a head control board (not shown) mounted on the carriage 38.

Based on the pulse signal, the moving direction and speed of the carriage 38 are calculated, and the reciprocating motion of the carriage 38 is controlled.

Under the guide rails 43 and 44, the platen 42 is located to face the recordation head 39. The platen 42 is provided to occupy a central portion in which the sheet of paper passes and which is defined within a region in which the carriage 38 reciprocates. The platen 42 holds the sheet of paper on the top surface thereof. The width of the top surface of the platen 42 in the reciprocating direction 105 is sufficiently larger than the maximum width of the sheet of paper which the print unit 11 supports. The distance between the recordation head 39 and the sheet of paper held on the top surface of the platen 42 is kept constant.

In the MFP 10, a main board and the head control board of the recordation head 39 is connected via a flat cable 52 through which various signals are transmitted. For example, a recordation signal is transmitted from the main board to the head recordation board via the flat cable 52. The flat cable 52 is a thin strip-shaped member configured by covering a plurality of wires for transmitting electric signals with a synthetic resin film such as a polyester film. Similar to the ink tube, the flat cable 52 elastically deforms along with the reciprocating motion of the carriage 38.

As described above, the carriage 38 is reciprocated while the carrying roller 60 and the ejection roller 62 are stopped. While the carriage 38 reciprocates, the recordation head 39 is controlled to eject a minute drop of ink of each color selectively from the nozzles toward the platen 42. As shown in FIG. 10, an ejecting direction 108 in which a drop of ink is ejected from the nozzle surface 40 is a vertically downward direction.

Therefore, the ejection direction 108 is perpendicular to both of the normal carrying direction 104 and the reciprocating direction 105. By selectively ejecting drops of ink from the nozzle surface 40 to fall on the sheet of paper on the platen 42, a required image is recorded on the sheet of paper.

Figure 7:
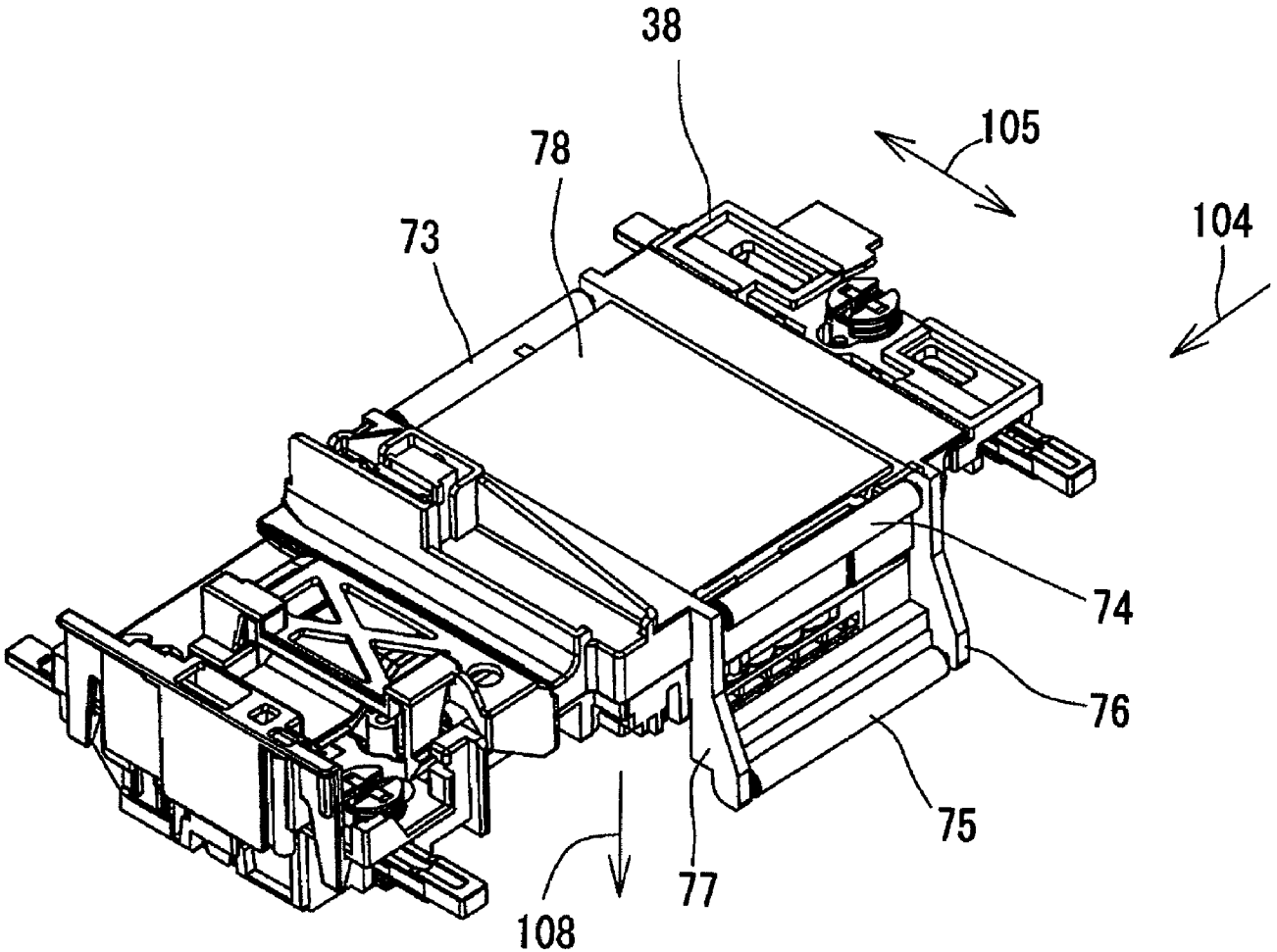
FIG. 7 is a perspective view illustrating the configuration of the carriage.
Figure 8:
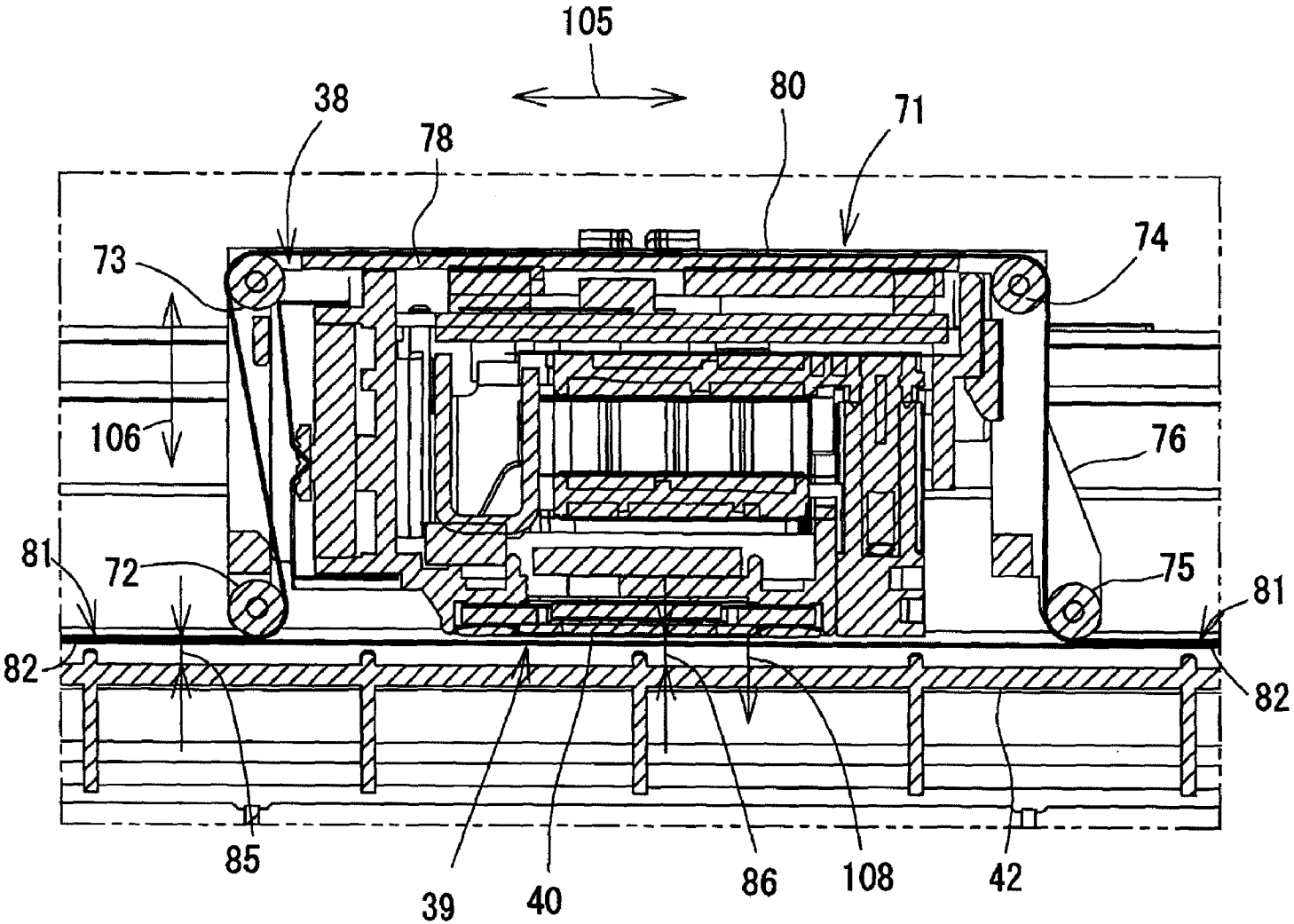
FIG. 8 is a cross section viewed along a cut line VIII-VIII in FIG. 4.

As shown in FIGS. 7 and 8, the carriage 38 is provided with four rollers 72 to 75. The carriage 38 is provided with brackets 76 and 77 respectively provided on the upstream and downstream end portions of the carriage 38 to protrude in the reciprocating direction. A rotation axis of each of the rollers 72 to 75 is supported by the brackets 76 and 77. That is, each of the rollers 72 to 75 is attached to the carriage 38 to be rotatable about an axis direction which is in parallel with the normal carrying direction.

The length of each of the rollers 72 to 75 in the axis direction is substantially equal to or slightly larger than the width of the guide film 71. The rollers 72 to 75 are provided at upper and lower edges of the both end portions defined in the reciprocating direction 105. That is, the rollers 72 to 75 are located at four corners of the carriage 38.

The rollers 72 to 75 reciprocate with the reciprocating motion of the carriage 38, and each of the rollers 72 to 75 moves relative to the guide film 71 while rotating, in accordance with the reciprocating motion of the carriage 38.

As shown in FIG. 7, an ink absorber 78 is provided on the top surface of the carriage 38. The ink absorber 78 is made of material capable of absorbing and holding ink ejected from the recordation head 39. For example of such material, water-absorbing resin or water-absorbing fabric can be used. The ink absorber 78 has a rectangular parallelepiped shape formed to occupy substantially the entire region defined by the rollers 73 and 74 located at the upper ends of the carriage 38 and the brackets 76 and 77. The top surface of the ink absorber 78 is positioned to be slightly higher than the top of each of the rollers 73 and 74. That is, the ink absorber 78 is positioned between the carriage 38 and a facing surface 82 of the guide film 71 sliding relatively over the carriage 38 while being taken up by the rollers 73 and 74, and contacts the guide film 71. The carriage 38 slides with respect to the guide film 78 with the reciprocating motion of the carriage 38.

Figure 5:
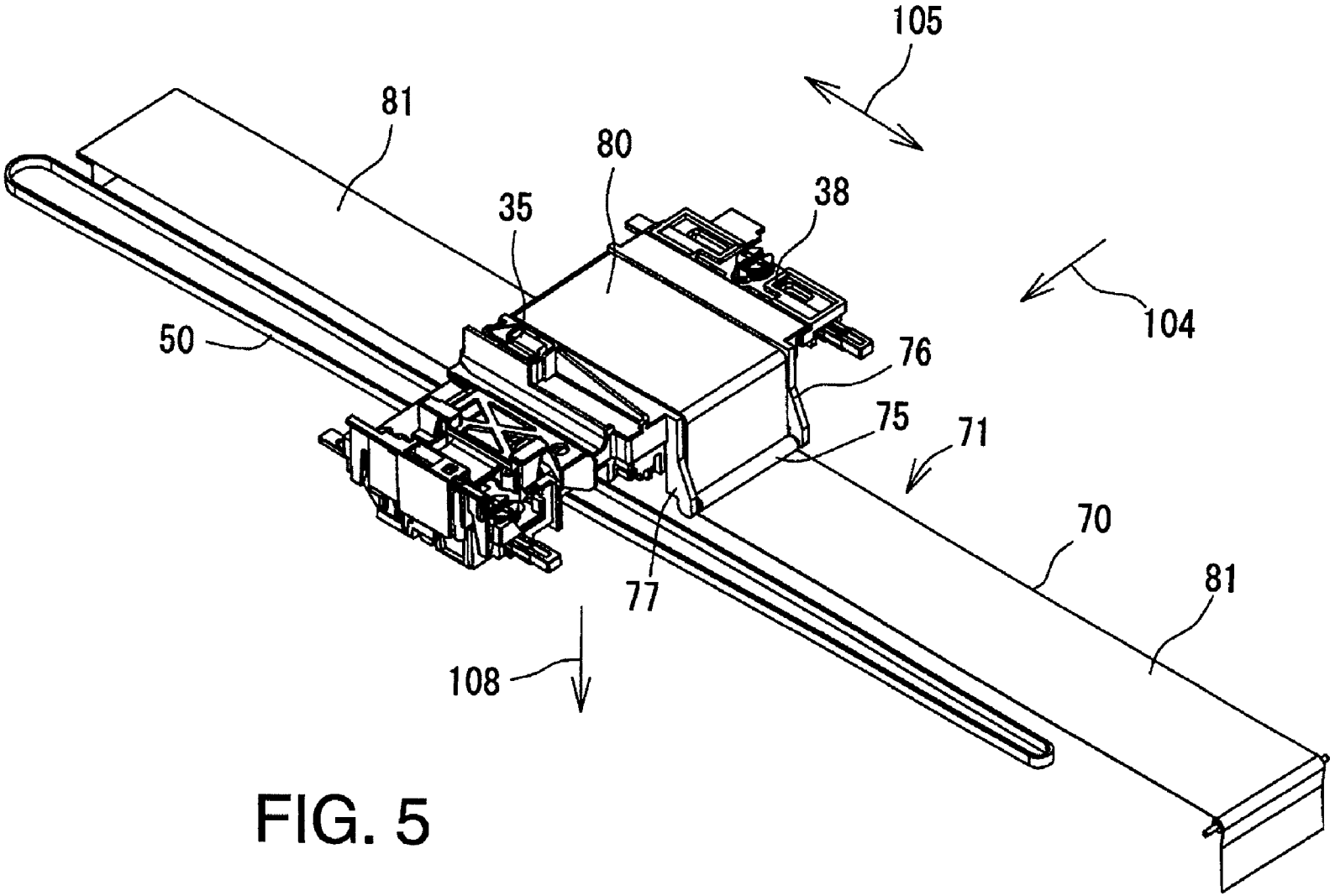
FIG. 5 is a perspective view illustrating a configuration of a carriage and a guide film.

As shown in FIGS. 4 to 6, the guide film 71, e.g., a long member, has a strip-shaped shape. Ends of the guide film 71 are respectively connected to both edge portions in the region of the reciprocating motion of the carriage 38. More specifically, an end of the guide film 71 is fixed to a frame of the print unit 11 via a fixing member 65, e.g., a support member, so that the one end does not move relative to the platen 42, while the other end of the guide film 71 is directed downward while being taken up by the roller 66, and is fixed to the frame of the print unit 11 via a fixing member (not shown) so as not to move relative to the platen 42.

Although not shown in the figures, the tension of the other end of the guide film 71 can be adjusted by the fixing member.

The guide film 71 is deformed to surround the carriage 38 excepting the nozzle surface 40 while being taken up by the rollers 72 to 75. A part of the guide film 71 being deformed around the carriage 38 is referred to as a deformed part 80. Excepting the deformed part 80, a part of the surface of the guide film 71 facing the top surface of the platen 42 is referred to as a facing part 81.

As shown in FIG. 8, the deformed part 80 of the guide film 71 is formed to move away from or approach the platen 42 along the sides of the carriage 38 while being taken up by the rollers 72 and 75 located at the lower end portions defined in the reciprocating direction 105 of the carriage 38, and is extended along the top surface of the carriage 38 while being taken up by the rollers 73 and 74. Further, the guide film 71 contacts the ink absorber 78 on the side of the top surface of the carriage 38. A direction in which the guide film 71 approaches or moves away from the platen 42 along the sides of the carriage 38 is defined as a deforming direction 106 (see FIG. 8).

As shown in FIG. 8, the facing part 81 of the guide film 71 is positioned to be slightly closer to the platen 42 than the nozzle surface 40 of the recordation head 39, and is formed to extend in the reciprocating direction 105 from each of the both ends of the carriage 38. The direction in which the part of the guide film 71 other than the deformed part 80 extends is defined as the longitudinal direction, while a shorter side direction of the guide film 71 is defined as a direction which is parallel with the normal carrying direction. A surface which is selected from front and back surfaces of the guide film 71 and which faces the platen 42 is referred to as the facing surface 82.

As shown in FIG. 6, the width 83 of the guide film 71 defined in the normal carrying direction 104 is larger than the length 84 of the nozzle surface 40 of the recordation unit 39 defined in the normal carrying direction 104. Further, the guide film 71 is positioned such that in the normal carrying direction, the nozzle surface 40 is located within the width 83 of the guide film 71. The paper sensor 32 provided on the carriage 38 is also positioned within the width 83 of the guide film 71.

As shown in FIG. 8, around the carriage 38, a first interval 85 between the facing surface of the guide film 71 and the top surface 42 of the platen 42 is slightly smaller than a second interval 86 between the nozzle surface 40 of the recordation unit 29 and the top surface of the platen 42. It should be noted that the nozzle surface 40 is defined as a position of the recordation unit 39 closest to the platen 42.

With the reciprocating motion of the carriage 38, the guide film 71 deforms such that the deformed part 80 follows the reciprocating carriage 38. For example, as show in FIGS. 10A and 10B, when the carriage 38 moves in the direction indicated by an arrow 117 (i.e., in the leftward direction on FIGS. 10A and 10B), the guide film 71 deforms such that the deformed part 80 follows the carriage 38 while being guided by the rollers 72 to 75. That is, the facing part 81 becomes the deformed part 80 while being taken up by the roller 72 of the carriage 38, and the deformed part 80 becomes the facing part 81 after the roller 74 passes the deformed part 80. Even though the deformed part 80 of the carriage 38 follows the reciprocating motion of the carriage 38, the facing part 81 does not move relative to the platen 42.

As shown in FIG. 9, an introducing film 87 is provided to be elongated from the downstream side of the carrying roller 60 in the normal carrying direction 104 toward the guide film 71. The introducing film 87 has a form of a thin film, and is located such that a first edge 88 defined on the upstream side in the normal carrying direction 104 is situated at a position which is an immediately downstream position with respect to the surface of the carrying roller 60 and which is slightly higher than the nipping position between the carrying roller 60 and the pinch roller 61. A second edge 89 of the introducing film 87 is situated at a position which is on the downstream side of an upstream edge 70 of the guide film 71 and which does not reach the position facing the nozzle surface 40 of the recordation head 39 and the paper sensor 32. The sheet of paper being carried while being nipped by the carrying roller 60 and the pinch roller 61 is introduced into the gap between the guide film 71 and the platen 42 while being guided by the introducing film 87.

Figure 13:
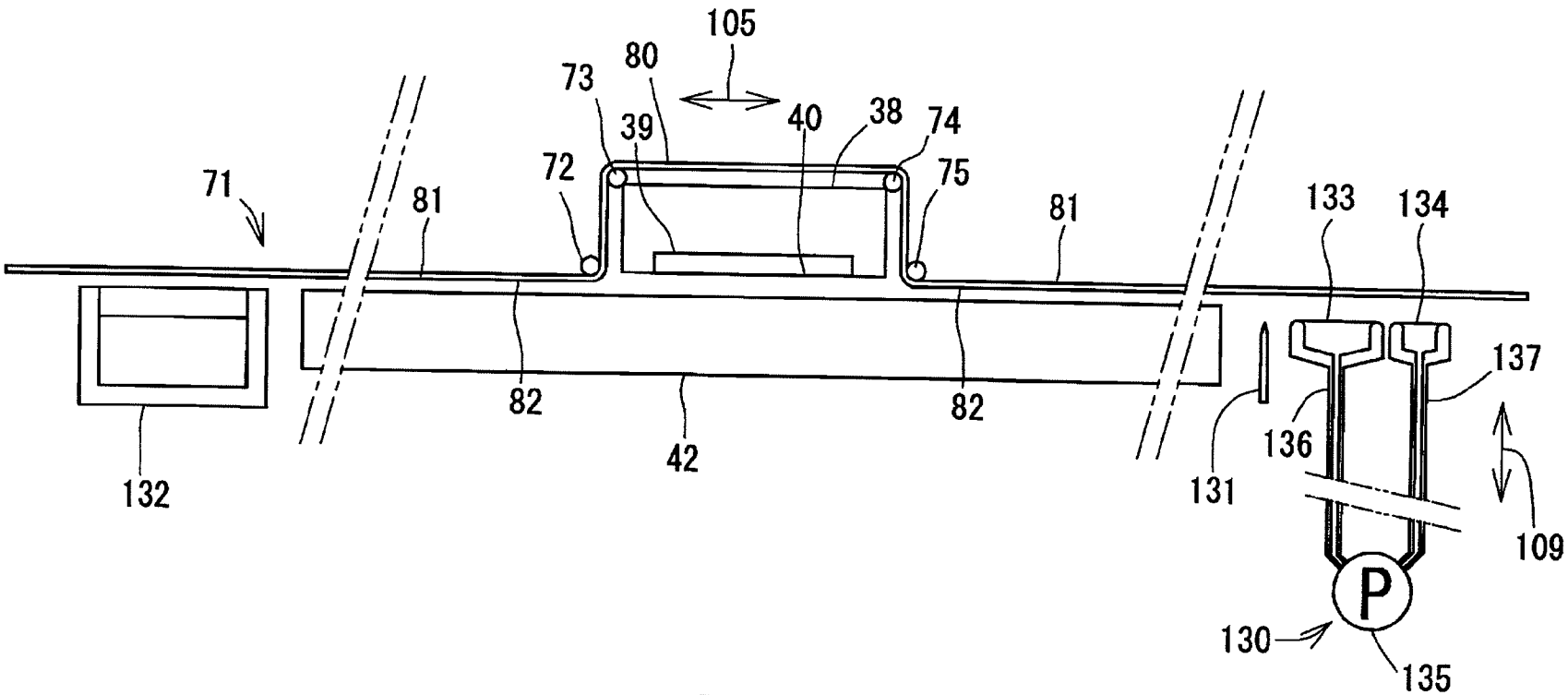
FIG. 13 illustrates an arrangement of a purge mechanism, a wiper and a discarded ink tray.

As shown in FIGS. 4 and 13, at the both ends of the platen 42 in the reciprocating direction 105, a purge mechanism 130, a wiper 131 and a discarded ink tray 132 are provided. In FIG. 4, the purge mechanism 130, the wiper 131 and the discarded ink tray 132 are hidden by the guide film 71. The purge mechanism 130 and the wiper 131 are located on the same end portion in the reciprocating direction 105 with respect to the platen 42 (i.e., on the right side on FIG. 13), and only the discarded ink tray 132 is located on the opposite end portion in the reciprocating direction with respect to the platen 42 (i.e., on the left side on FIG. 13).

The purge mechanism 130 includes, as main parts, caps 133 and 134, and a suction pump 135. Each of the caps 133 and 134 is driven to approach or move away from the nozzle surface 40 of the recordation head 39 as indicated by an arrow 109 shown in FIG. 13 through a driving mechanism (not shown). Each of the caps 133 and 134 closely contacts the nozzle surface 40 to cover each nozzle orifice with enclosed space. The cap 133 covers the nozzle orifices for ejecting cyan, magenta and yellow ink, and the cap 134 covers the nozzle orifices for ejecting black ink. A lip part of each of the caps 133 and 134 closely contacting the nozzle surface 40 is formed of an elastic member such as rubber. By deformation of the lip part of each of the caps 133 and 134, the lip part is able to closely contact the nozzle surface 40 so as to form the enclosed space as the inner space of each of the caps 133 and 134.

On the bottom of each of the caps 133 and 134, an opening is formed. Through channels 136 and 137 respectively communicating with the openings of the caps 133 and 134, the caps 133 and 134 are connected to the suction pump 135. When the suction pump 135 is activated, suction pressure is caused in each of the inner spaces of the caps 133 and 134 through the channels 133 and 134. When each of the caps 133 and 134 closely contacts the nozzle surface 40, ink is sucked from the nozzles of the recordation head 39 to the inside of each of the caps 133 and 134 by the suction pressure. When ink of each color is sucked from the recordation head 39, air bubbles and dusts caused in the recordation head 39 are also sucked together with the ink to the inside of each of the caps 133 and 134. In this specification, such a sucking operation is frequently referred to as a purge motion.

The wiper 131 wipes the ink adhered to the nozzle surface while contacting the nozzle surface 40 of the recordation head 39. The wiper 131 is a plate-like member formed of elastic material such as rubber. The wiper 131 has a width longer than the range within which all the nozzle orifices are arranged on the nozzle surface 40 in the normal carrying direction 104, and the wiper 131 is positioned such that the width direction of the wiper 131 is equal to the normal carrying direction 104. The wiper 131 is driven by a driving mechanism (not shown) to approach or move away from the nozzle surface 40 of the recordation head 39 as indicated by the arrow 109.

The wiper 131 is located on the side of the platen 42 with respect to the purge mechanism 130. The wiper 131 is used mainly for the purpose of wiping residual ink on the nozzle surface 40 purged by the purging mechanism 130. The wiper 131 contacts the nozzle surface 40 when the purged recordation head 39 returns to the position facing the nozzle surface 40 along with the carriage 38, and wipes the ink adhered to the nozzle surface 40 by the relative movement of the wiper 131 with respect to the nozzle surface 40. In this specification, such motion of the wiper 40 to wipe the ink on the nozzle surface 40 is frequently referred to as "wiping".

The discarded ink tray 132 is formed to receive ink ejected from the recordation head 39 for maintenance. The recordation head 39 has a form of a tray corresponding to the nozzle surface 40 of the recordation head 39, and accommodates therein an ink absorber. The ink absorber absorbs drops of ink ejected from the recordation head 39 and holds the ink. For example, when the ink on the nozzle surface 40 has purged and then wiped by the wiper 131, a possibility that ink of different color is mixed into each nozzle orifice or a possibility that a meniscus shape of a drop of ink formed on each nozzle orifice is deteriorated arises. Therefore, by ejecting drops of ink from all the nozzle orifices of the recordation head 39 after the purging, it is possible to eject the mixed ink from each nozzle orifice and to restore the condition of each nozzle orifice to a normal condition. In this specification, such ejecting motion is frequently referred to as "flushing".

As shown in FIG. 13, the guide film 71 is extended in the reciprocating direction 105 to cover the caps 133 and 134 of the purge mechanism 130, the wiper 131 and the discarded ink tray 132. Further, the carriage 38 is able to move to the positions facing the caps 133 and 134 of the purge mechanism 130, the wiper 131 and the discarded ink tray 132.

Hereafter, the image recordation operation is explained in detail.

When a command for starting the image recordation is inputted, for example, through the operation panel 14. The sheet of paper 90 accommodated in the paper supply tray 20 is supplied to the paper carrying path 23. The sheet of paper 90 supplied to the paper carrying path 23 is carried to the platen 42 while being nipped by the carrying roller 60 and the pinch roller 61. In the process where the sheet of paper 90 passes the registration sensor 37, the leading edge of the sheet of paper is recognized by the MFP 10.

The leading edge of the sheet of paper 90 being supplied while being nipped by the carrying roller 60 and the pinch roller 61 is guided by the introducing film 87, and is directed to the space between the guide film 71 and the platen 42. When the leading edge of the sheet of paper 90 enters the image recordation region by the recordation head 39, the carrying roller 60 is controlled to rotate intermittently on the basis of a predetermined carrying amount. When the carrying roller 60 is stopped intermittently, the carriage 38 is controlled to reciprocate in the reciprocating direction 105. While the carriage 38 reciprocates, ink of each color is ejected selectively from the nozzles of the nozzle surface 40 of the recordation head 39 in the ejecting direction 108.

Such ejection motion of ink drops may be performed in both directions of the reciprocating motion of the carriage 38 or in either of directions of the reciprocating motion of the carriage 38. The ink drops ejected from the nozzle surface 40 fall on the sheet of paper 90 placed on the platen 42. Consequently, the image recordation for one pass is finished.

After the carriage 38 reciprocates one time, the carrying roller 60 is rotated by the predetermined carrying amount to carry the sheet of paper 90 in the normal carrying direction on the platen 42. Then, when the carrying roller 60 is stopped intermittently, the carriage 38 is reciprocated in the reciprocating direction 105, and the ink drops are selectively ejected from the nozzle surface 40 of the recordation head 39 to finish the image recordation for the second pass. By repeating such operations, a required image is formed on the sheet of paper 90.

For rimless printing on the sheet of paper 90, the rim of the sheet of paper on the platen 42 is detected based on the output signal from the paper sensor 32. Since as described above the paper sensor 32 is located within the width 83 of the guide film 71 on the lower surface of the carriage 38, the light emitted from the paper sensor 32 reaches the sheet of paper 90 on the platen 42 without being blocked by the introducing film 87. Then, the ink drops are ejected to the position corresponding to the rim of the sheet of paper 90 so that the rimless printing is performed on the sheet of paper 90.

Figure 10A:
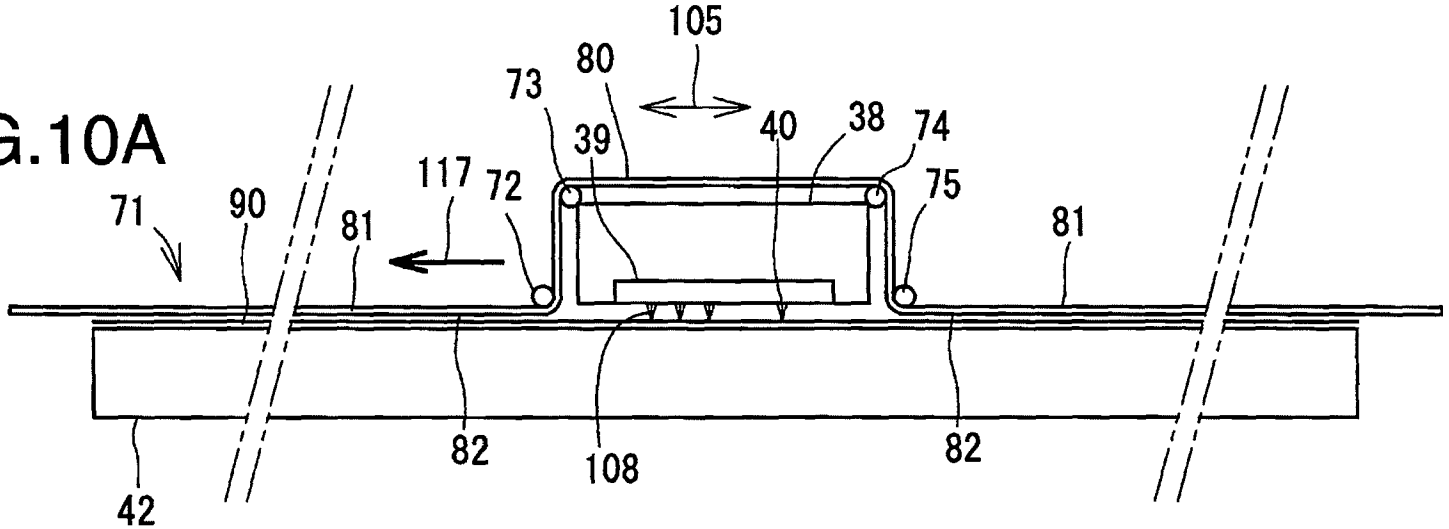
FIGS. 10A and 10B illustrate the situation where a part of the guide film deforms to follow movement of the carriage.
Figure 10B:
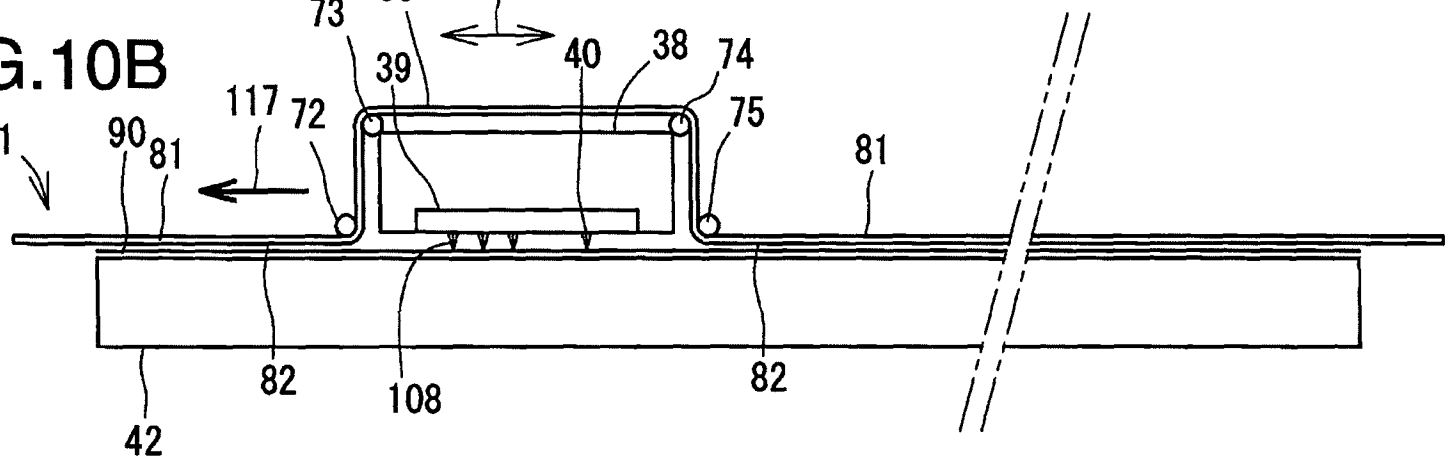

Regarding the above described image recordation operation, it should be noted that the guide film 71 is located in the region in which the carriage 38 reciprocates. As shown in FIGS. 10A and 10B, the deformed part 80 of the guide film 71 follows the reciprocating motion of the carriage 38, while the facing part 81 of the guide film 71 does not move in the reciprocating direction relative to the platen 42. Therefore, the sheet of paper 90 on the platen 42 is positioned by the facing surface 81 of the guide film 70 at a position nearer to the platen 42 with respect to the nozzle surface 40 of the recordation head 39.

As described above, according to the configuration of the print unit 11, the facing part 81 of the guide film 71 extended in the reciprocating direction 105 within the region where the carriage 38 reciprocates does not move in the reciprocating direction 105 relative to the platen 42 even when the carriage 38 reciprocates. Therefore, it becomes possible to position the sheet of paper 90 on the platen 42 at a position nearer to the platen 42 with respect to the nozzle surface 40 of the recordation head 39. In this state, the image recordation by the recordation head 39 is performed while the carriage 38 reciprocates in the reciprocating direction 105 with respect to the sheet of paper 90. Therefore, even if a sheet of paper 90 a part of which is folded is carried to the platen 42 or a sheet of paper on which ink drops have fallen is bent largely on the platen 42, the jamming of the sheet of paper 90 due to contact with the carriage 38 or the recordation head 39 can be prevented, and the image on the sheet of paper can be prevented from being damaged because the sheet of paper is not moved in the reciprocating direction 105 on the platen 42.

Since the facing part 81 of the guide film 71 does not move in the reciprocating direction 105 relative to the sheet of paper 90 on the platen 42, it becomes possible to prevent the ink drops fallen on the sheet of paper 90 from being damaged due to contact with the carriage 38 or the recordation head 39.

Since the facing surface 82 of the guide film 71 slides on the ink absorber 78 when the carriage 38 reciprocates, the ink transferred from the sheet of paper 90 to the facing surface 82 or ink mist adhered to the facing surface can be absorbed by the ink absorber 78. Consequently, it becomes possible to prevent the sheet of paper 90 is soiled with the ink or ink mist adhered to the facing surface 82 of the guide film 71.

As described above, the deformed part 80 of the guide film 71 moves to follow the movement of the carriage 38, it is possible to provide a sheet of film, as the guide film 71, over the entire reciprocating region of the carriage 38. Therefore, it is possible to stabilize the tension to hold the guide film 71 over the entire reciprocation region of the carriage 38. Consequently, the resistance given from the guide film 71 to the reciprocating motion of the carriage 38 can be reduced, and therefore the precise movement of the carriage 38 can be secured.

As described above, the guide film 71 has a form of a strip, and is configured to have the facing surface 82 facing the top surface of the platen 42. Therefore, it is possible to reliably press the sheet of paper 90 on the platen 42 with a flat face.

Around the carriage 38, the first interval 85 between the facing surface 82 of the guide film 71 and the platen 42 is slightly smaller than the second interval 86 between the nozzle surface 40 of the recordation head 39 and the platen 42. Therefore, it is possible to prevent the sheet of paper 90 on the platen 42 from contacting the nozzle surface 40 of the recordation head 39, and thereby to prevent the sheet of paper 90 from jamming due to the reciprocating motion of the carriage 38.

Since the width 83 of the facing part 81 of the guide film 71 is larger than the length 74 of the nozzle surface 40 in the normal carrying direction 104, it is possible to reliably prevent occurrence of paper jamming due to contact between the nozzle surface 40 of the recordation head 39 and the sheet of paper 90. Since the sheet of paper is positioned to have the predetermined distance from the platen 42 in the reciprocating region of the nozzle surface 40, the image recordation can be performed with a high degree of precision.

Since the paper sensor 32 is positioned within the width 83 of the guide film 71 on the carriage 38, the introducing film 87 does not exist between the platen 42 and the paper sensor 32. Therefore, it becomes possible to detect the sheet of paper 90 on the platen 42 by the paper sensor 32 without being effected by the introducing film 87.

The introducing film 87 is provided on the upstream side in the normal carrying direction with respect to the guide film 71, the sheet of paper 90 is guided to the space between the guide film 71 and the platen 42. Therefore, it is possible to prevent the leading edge of the sheet of paper 90 from contacting the frame of the guide film 71.

As described above, the ink absorber 78 slides on the facing surface 82 of the guide film 71 with the reciprocation motion of the carriage 38. Therefore, even if the ink mist or the ink which has fallen on the sheet of paper adheres to the facing surface 82, the ink can be removed from the facing surface 82. Consequently, it is possible to prevent the sheet of paper 90 from being soiled by the ink or ink mist adhered to the facing surface 82.

The purge mechanism 130, the wiper 131 and the discarded ink tray 132 arranged in the reciprocating direction 105 with respect to the platen 42, and the recordation head 39 is situated at positions facing the purge mechanism 130, the wiper 131 and the discarded ink tray 132 when the carriage 38 is moved in the reciprocating direction 105. Such a configuration makes it possible to perform the maintenance operation while contacting the purge mechanism 130 and the wiper 131 with the recordation head 39.

When the recordation head 39 is not situated at the positions of the purge mechanism 130, the wiper 131 and the discarded ink tray 132, the purge mechanism 130, the wiper 131 and the discarded ink tray 132 are covered by the guide film 71. Consequently, it is possible to prevent dust from adhering to the purge mechanism 130, the wiper 131 and the discarded ink tray 132, and to prevent the purge mechanism 130, the wiper 131 and the discarded ink tray 132 from being touched by a user.

Variations of First Embodiment

In the above described first embodiment, the ink absorber 78 is provided on the top surface of the carriage 38 so that the ink absorber 78 can slide on the guide film 71 with the reciprocating motion of the carriage 38. However, in place of providing the ink absorber 78, an ink absorber may be provided on the surface of each of the rollers 73 and 74 provided on the upper side of the carriage 38. In this case, when the carriage 38 reciprocates, the guide film 71 moves relative to the roller 73 and 74 while rotating each of the rollers 73 and 74, and the facing surface 82 of the guide film 71 contacts the surface of each of the rollers 73 and 74. Therefore, by providing an ink absorber on the surface of each of the rollers 73 and 74, it is possible to remove the ink or ink mist adhered to the facing surface 82 of the guide film 71.

Second Embodiment

Hereafter, a second embodiment is described. Since the basic configuration of an MFP according to the second embodiment is substantially the same as that of the first embodiment, in the following the explanation focuses on the feature of the second embodiment for the sake of simplicity. Therefore, in the following, the reference numbers in the first embodiment are also used for the explanation of the second embodiment. The feature of the second embodiment is that the MFP has guide films 91 and 92.

Figure 11:
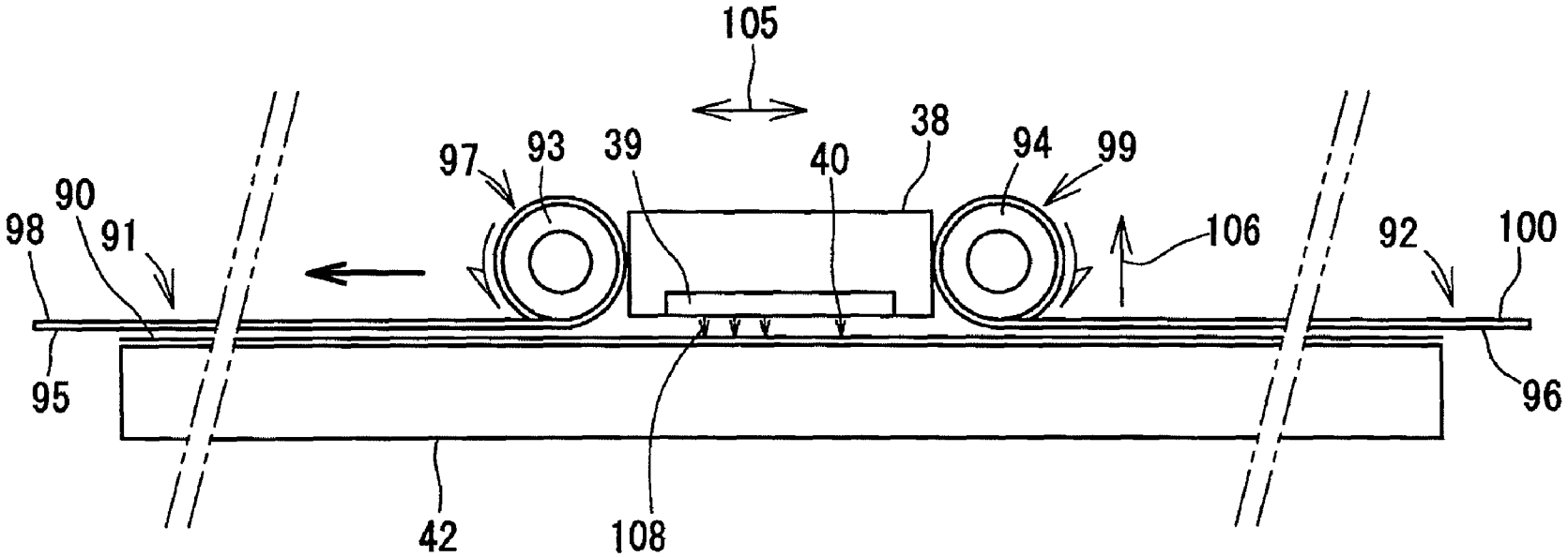
FIG. 11 is an explanatory illustration for explaining winding of guide films with movement of the carriage in a reciprocating direction.

FIG. 11 is an explanatory illustration for explaining winding of the guide films 91 and 92 with movement of the carriage 38 in the reciprocating direction 105. As shown in FIG. 11, the carriage 38 is provided with two winding rollers 93 and 94. Each of the winding rollers 93 and 94 is rotatably attached to the carriage 38 to have an axis direction which is in parallel with the normal carrying direction 104. The length of each of the winding roller 93 and 94 in the axis direction is substantially equal to or slightly larger than the width of each of the guide films 91 and 92. The winding rollers 93 and 94 are provided at both end portions of the carriage 38 in the reciprocating direction 105. Each of the winding rollers 93 and 94 is positioned such that the lower most position of each of the winding rollers 93 and 94 is nearer to the platen 42 with respect to the nozzle surface 40 of the recordation head 39.

Although not shown in FIG. 11, each of the winding rollers 93 and 94 is provided with a coil spring to press the winding roller (93, 94) to rotate in the winding direction for winding the guide film (91, 92). By the pressing force of the coil spring, the winding roller 93 is pressed to rotate in the counterclockwise direction on FIG. 11, and the winding roller 94 is pressed to rotate in the clockwise direction on FIG. 11 as indicated by arrows in FIG. 11. By the two winding rollers 93 and 94, the guide films 91 and 92 are wound or withdrawn.

Similarly to the guide film 71 in the first embodiment, each of the guide films 91 and 92 has a form of a strip. The guide films 91 and 92 are connected to the carriage 38 at both end portions in the reciprocating direction 105. One end of the guide film 91 (92) is wound by the winding roller 93 (94). Therefore, the guide films 91 and 92 are respectively extended from the both ends of the carriage 38 in the reciprocating direction at the position slightly nearer to the platen 42 that the nozzle surface of the recordation head 39.

The guide film 91 is fixed with a fixing member 65 at the end of the reciprocating region of the carriage 38 so as not to move relative to the platen 42, and is extended to the winding roller 93 in the reciprocating direction 105 to be wound by the winding roller 93. The guide film 92 is fixed with a fixing member 65 at the end of the reciprocating region of the carriage 38 so as not to move relative to the platen 42, and is extended to the winding roller 94 in the reciprocating direction 105 to be wound by the winding roller 94. The direction in which each of the guide films 91 and 92 is extended is defined as the longitudinal direction, and the shorter side direction of each of the guide films 91 and 92 is parallel with the normal carrying direction 104.

By winding the guide films 91 and 92 extended from the both ends in the reciprocating region of the carriage 38 with the winding rollers 93 and 94, the guide films 91 and 92 can be provided over the entire reciprocating region of the carriage 38. The guide films 91 and 92 are withdrawn from the winding rollers 93 and 94, or are wound by the winding rollers 93 and 94. By winding the guide films 91 and 92 with the winding rollers 93 and 94, the guide films 91 are 92 are moved away from the platen 42 in the deforming direction 106. On the other hand, by withdrawing the guide films 91 and 92 from the winding rollers 93 and 94, the guide films 91 and 92 approach the platen 42 at the both ends of the carriage 38.

Both sides of each of the guide films 91 and 92 are extended horizontally. The surface of the guide film 91 facing the platen 42 is referred to as a facing surface 95, and the surface of the guide film 92 facing the platen 42 is referred to as a facing surface 96.

A part of the guide film 91 wound by the winding roller 93 is referred to as a deformed part 97, and the other part of the guide film 91 other than the deformed part 97 facing the platen 42 is referred to as a facing part 98. A part of the guide film 92 wound by the winding roller 94 is referred to as a deformed part 99, and the other part of the guide film 92 other than the deformed part 99 facing the platen 42 is referred to as a facing part 100.

Although not shown in FIG. 11, the width of each of the guide films 91 and 92 defined in the normal carrying direction 104 is larger than the length 84 of the nozzle surface 40 in the normal carrying direction 104. In addition, each of the guide films 91 and 92 is positioned with respect to the carriage 38 such that the nozzle surface 40 is positioned within the width of each of the guide films 91 and 92. Furthermore, the paper sensor 32 on the carriage 38 is also positioned within the width of each of the guide films 91 and 92.

As in the case of the first embodiment, the guide films 91 and 92 are provided in the reciprocating region of the carriage 38, and each of the deformed parts 97 and 98 of the guide films 91 and 92 moves to follow the reciprocating motion of the carriage 38 while winding or ejecting the guide film. On the other hand, the facing parts 98 and 100 of the guide films 91 and 92 do not move relative to the platen 42 in the reciprocating direction regardless of the reciprocating motion of the carriage 38. Therefore, the sheet of paper 90 on the platen 42 is situated by the facing parts 98 and 100 of the guide films 91 and 92 at the position nearer to the platen 42 with respect to the nozzle surface 40 of the recordation head 39. With this configuration, the same advantages achieved by the first embodiment are also obtained.

Variations of the First and Second Embodiments

Hereafter, variations of the first and second embodiments are described. The introducing film 87 may have transparency. In this case, it is possible to visibly recognize the condition of the sheet of paper 90 on the platen 42 through the introducing film 87. The paper sensor 32 may not be located within the width of each of the guide films 71, 91 and 92, but may be located, for example, on the upstream side in the normal carrying direction 104 with respect to the carriage 38. In this case, it is also possible to optically detect the sheet of paper 90 through the introducing film 87.

The introducing film 87 may be configured to have one or more hole penetrating through the film in the deforming direction 106 (i.e., the thickness direction). With this structure, it becomes possible to visibly recognize the condition of the sheet of paper 90 on the platen 42 through the hole of the introducing film 87. In this case, even if the paper sensor 32 is not positioned within the width of each of the guide films 71, 91 and 92 (for example, if the paper sensor 32 is located on the upstream side of the carriage 38 in the normal carrying direction), it is possible to optically detect the sheet of paper 90 through the hold of the introducing film 87.

Third Embodiment

Hereafter, a third embodiment is described. Since the basic configuration of an MFP according to the third embodiment is substantially the same as that of the first embodiment, in the following the explanation focuses on the feature of the third embodiment for the sake of simplicity. Therefore, in the following, the reference numbers in the first embodiment are also used for the explanation of the third embodiment. The feature of the third embodiment is that the MFP has guide wires 54.

Figure 12:
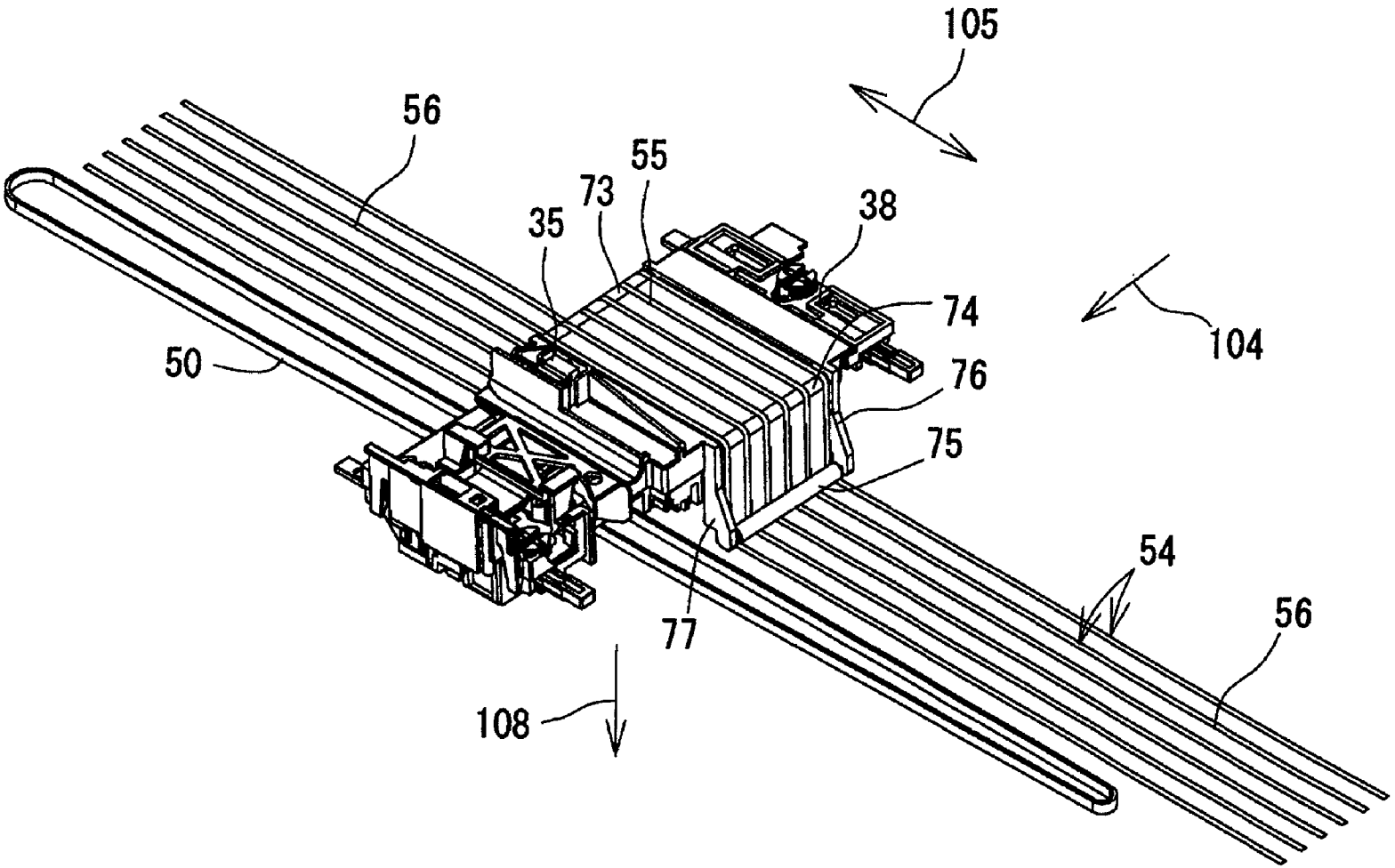
FIG. 12 illustrates the configuration of the carriage and guide wires according to a third embodiment.

As in the case of the first embodiment, the carriage 38 is provided with the four rollers 72 to 75, and on the top surface of the carriage 38, the ink absorber 78 is provided. FIG. 12 illustrates the configuration of the carriage 38 and the guide wires 54 according to the third embodiment. As shown in FIG. 12, each guide wire 54 has a funicular shape. The guide wire 54 is connected to both ends of the carriage 38 in the reciprocating direction, and is stretched in the reciprocating direction 105 to have a certain tension. In this embodiment a plurality of guide wires 54 are arranged at predetermined intervals in the normal carrying direction 104.

By being wound by the rollers 72 to 75 provided on the carriage 38, the guide wire 54 is deformed to surround the surface of the carriage 38 other than the nozzle surface 40. A part of the guide wire 54 deformed around the carriage 38 is referred to as a deformed part 55. A part of the guide wire 54 other than the deformed part 55 facing the platen 42 is referred to as a facing part 56. The direction in which the guide wire 54 is wound by the rollers 72 and 75 to approach or move away from the platen 42 around the deformed part 55 is referred to as a deforming direction 106.

The facing part 56 of the guide wire 54 is extended in the reciprocating direction from the both ends of the carriage 38 in the reciprocating direction at the position nearer to the platen 42 with respect to the nozzle surface 40 of the recordation head 39. The guide wire 54 is fixed at end portions in the reciprocating region of the carriage 38 with the fixing member 65 and the roller 66 so a not to move relative to the platen 42. The direction in which the part of guide wire 54 other than the deformed part 55 is extended is defined as the longitudinal direction. The length of the region in which the plurality of guide wires 54 are arranged in the normal carrying direction is larger than the length 84 of the nozzle surface 104 in the normal carrying direction 104.

Although not shown in FIG. 12, the interval between the facing part of the guide wire 54 and the top surface of the platen 42 is slightly smaller than the interval between the nozzle surface 40 of the recordation head 39 and the top surface of the platen 42.

As in the case of the guide film 71 according to the first embodiment, the deformed part 55 of the guide wire 54 moves to follow the reciprocation motion of the carriage 38. When the deformed part 55 moves to follow the reciprocating motion of the carriage 38, the facing part 56 does not move in the reciprocating direction 105 relative to the platen 42. Therefore, the sheet of paper 90 on the platen 42 is situated by the facing part 56 of the guide wire 54 at the position nearer to the platen 42 with respect to the nozzle surface 40 of the recordation head 39. With this configuration, the same advantages achieved in the first embodiment are also obtained.

Since the plurality of guide wires 54 are arranged along the normal carrying direction, it is possible to position the sheet of paper 90 to have the predetermined interval from the platen 42 at a plurality of points along the normal carrying direction.

Although the plurality of guide wires 54 are provided in the third embodiment, only one wire 54 may be provided in the MFP. Even if only one guide wire is provided in the MFP, it is possible to position the sheet of paper 90 on the platen 42 to be nearer to the platen 42 than the nozzle surface 40 of the recordation head 39.

What is claimed is:

1. An image recording device, comprising:

a platen that supports a recording medium;

a carriage that is located to face the platen and is configured to move in a first direction along the recoding medium;

a recordation head that is mounted on the carriage and performs image recordation on the recording medium;

a long member elongated, to face the platen, in the first direction within a region in which the carriage moves;

a support member that fixes the long member such that the long member does not move in the first direction relative to the platen; and a guide member that is located on the carriage to deform the long member such that the carriage and the platen face directly with respect to each other, wherein the guide member deforms the long member in accordance with movement of the carriage in such a manner that the long member deforms in a second direction to move away from or approach the platen, and wherein the guide member deforms the long member in the second direction to surround the carriage.

2. The image recording device according to claim 1, wherein: the guide member includes winding rollers provided at both ends of the carriage in the first direction; and the long member is deformed in the second direction by being wound by the winding rollers.

3. The image recording device according to claim 1, wherein the long member is a flat strip-shaped member having a flat face facing the platen.

4. The image recording device according to claim 1, wherein a first interval between the platen and the flat face of the long member in a vicinity of the carriage is smaller than or equal to a second interval between the platen and a point on the recordation head nearest to the platen.

5. An image recording device, comprising:

a platen that supports a recording medium;

a carriage that is located to face the platen and is configured to move in a first direction along the recoding medium;

a recordation head that is mounted on the carriage and performs image recordation on the recording medium;

a long member elongated, to face the platen, in the first direction within a region in which the carriage moves;

a support member that fixes the long member such that the long member does not move in the first direction relative to the platen; and a guide member that is located on the carriage to deform the long member such that the carriage and the platen face directly with respect to each other, wherein the long member is a flat strip-shaped member having a flat face facing the platen, and wherein the long member is configured such that a width defined on the flat face in a third direction perpendicular to the first direction is larger than a length of a recording region on the recordation head defined in the third direction.

6. An image recording device, comprising:

a platen that supports a recording medium;

a carriage that is located to face the platen and is configured to move in a first direction along the recoding medium;

a recordation head that is mounted on the carriage and performs image recordation on the recording medium;

a long member elongated, to face the platen, in the first direction within a region in which the carriage moves;

a support member that fixes the long member such that the long member does not move in the first direction relative to the platen; and a guide member that is located on the carriage to deform the long member such that the carriage and the platen face directly with respect to each other, wherein the long member has a funicular shape.

7. The image recording device according to claim 1, wherein the long member includes a plurality of funicular members arranged in a third direction perpendicular to the first direction such that each of the plurality of funicular members faces the plate.

8. The image recording device according to claim 1, further comprising:

a carrying unit configure to carry the recording medium to the platen; and an introducing film located on an upstream side in a carrying direction of the recording medium with respect to the long member so as to guide the recoding medium to space between the long member and the platen.

9. The image recording device according to claim 8, further comprising a sensor mounted on the carriage to detect the recording medium, wherein the sensor is located on the carriage within a width of the long member in a third direction perpendicular to the first direction.

10. The image recording device according to claim 8, wherein the introducing member has transparency.

11. The image recording device according to claim 8, wherein the introducing member has a through hole penetrating the introducing film in the second direction.

12. The image recording device according to claim 1, wherein the recordation head is an inkjet type head configured to selectively eject ink drops.

13. The image recording device according to claim 12, further comprising an ink absorber which absorbs ink and is located on the carriage to contact a side of the long member facing the platen.

14. The image recording device according to claim 13, wherein the ink absorber is located between the carriage and the long member, and slides on the long member relative to the long member along with movement of the carriage.

15. The image recording device according to claim 13, further comprising a roller which rotates while contacting the long member, wherein the ink absorber is provided on a surface of the roller.

16. The image recording device according to claim 1, further comprising maintenance units arranged in the first direction to perform maintenance for the recordation head, wherein: the carriage is configured to be able to move to a position facing the maintenance units; and the long member is elongated to face the maintenance units.

17. The image recording device according to claim 16, wherein the maintenance units include a purge mechanism having a cap formed to closely contact the recordation head to suck ink from the recordation head.

18. The image recording device according to claim 16, wherein the maintenance units include a wiper configured to wipe ink adhered to the recordation head.

19. The image recording device according to claim 16, wherein the maintenance units include a discarded ink tray which receives ink drops ejected from the recordation head.

* * * * *